US005515881A

United States Patent [19]

Ballew

[11] Patent Number: 5,515,881

[45] Date of Patent: May 14, 1996

[54] MULTI-STORAGE TANKS AND DISPENSING UNITS

[76] Inventor: Jack L. Ballew, 724 N. Burgess Rd., Holdenville, Okla. 74848

[21] Appl. No.: 255,400

[22] Filed: Jun. 8, 1994

[51] Int. Cl.[6] ..... B67D 5/60

[52] U.S. Cl. ..... 137/255; 137/312; 141/86

[58] Field of Search ..... 137/255, 259, 137/312; 141/86, 88, 325

[56] References Cited

U.S. PATENT DOCUMENTS

| | | | |
|---|---|---|---|
| 2,225,622 | 12/1940 | Clapp . | |
| 2,603,312 | 7/1952 | Tabet . | |
| 2,765,938 | 10/1956 | Addezio . | |
| 3,033,311 | 5/1962 | Edgar et al. . | |
| 3,095,062 | 6/1963 | Neely . | |
| 3,489,245 | 1/1970 | Broadwell . | |
| 3,810,487 | 5/1974 | Cable et al. . | |
| 3,867,999 | 2/1975 | Cox . | |
| 4,095,672 | 6/1978 | Senese . | |
| 4,193,487 | 3/1980 | Takeuchi . | |
| 4,457,349 | 7/1984 | Vazin | 137/312 X |
| 4,880,144 | 11/1989 | Shea . | |
| 5,016,689 | 5/1991 | McGarvey et al. . | |
| 5,062,500 | 11/1991 | Miller et al. . | |
| 5,114,046 | 5/1992 | Bryant . | |
| 5,184,939 | 2/1993 | Solomon et al. . | |
| 5,242,032 | 9/1993 | Prestwood et al. . | |
| 5,257,652 | 11/1993 | Lawrence | 137/312 X |
| 5,301,721 | 4/1994 | Hartmann | 141/86 X |
| 5,301,722 | 4/1994 | Todd et al. . | |

OTHER PUBLICATIONS

Alemite Sales Brochure, Package No. 338547 Alemite Corp.

Primrose Sales Brochure, Portable BulkTanks Primrose oil Co. Inc.

Petroleum Marketing Manangement Jul./Aug. 1993, pp. 14, 16–18, 23, 26, 27, 29 and 35.

*Primary Examiner*—Kevin Lee

*Attorney, Agent, or Firm*—R. William Graham

[57] ABSTRACT

The present invention is directed to multi-storage tanks and dispensing units, comprising a securable housing having a top panel, a back panel, side panels, a front panel having a door securable connected to said front panel, and a deck panel having a spill well and a grate positioned thereover. A plurality of bulk oil storage tanks are operably disposed within the housing on the deck panel, wherein one of the tanks is further characterized to be a waste tank.

20 Claims, 3 Drawing Sheets

MULTI-STORAGE TANKS AND DISPENSING UNITS

BACKGROUND OF THE INVENTION

1. Field of Invention

This invention relates to multi-storage tanks and dispensing units. More particularly, this invention relates to semi-mobile multi-storage bulk tanks and dispensing units which are disposed within an environmentally safe housing for use by individual consumers.

2. Brief Description of the Related Art

Bulk oil delivery is desirable for several reasons. It is commonly known that bulk oil is generally a cleaner product than that sold in smaller containers, such as quarts, to individual consumers. This is in part due to the fact there is an additional processing step involved which can introduce foreign matter into the oil. There are also contaminants introduced into the oil from the container and thus small containers introduce greater contaminants by virtue of greater surface area contact. Bulk oil tanks diminish such problems and further reduce the waste which occurs from packaging and container disposal. Bulk oil tanks also reduce cost of the product by avoiding the material, labor and handling required for small containers.

Existing bulk oil dispensing units include a tank operably connected to a pump dispenser. Traditionally, a bulk oil tank has commonly been stored underground and in a permanent fashion. Such underground tank is prone to deteriorate and pose an environmental hazard. Moreover, the underground tank is expensive to install and remove. More recently in an effort to overcome such problems, an above ground tank has been employed at a particular site location or bay area for commercial activities. Typically, a single tank is employed providing only means for dispensing a type of oil. Such tank, however, still lacks the necessary attributes to provide an environmentally positive with multiple oil choice service to the individual consumers. There lacks suitable safe portability for multiple bulk oil tanks. There also lacks any device for collecting and storing spilled or used oil for recycling.

There remains a need, therefore, for consumers situated in rural as well as urban areas, to handle bulk oil in a do-it-yourself type fashion with a multiple oil choice and environmentally safe manner. It is the aim of the present invention to provide bulk oil in such a manner and which overcomes the problems of the related art.

SUMMARY OF THE INVENTION

It is an object to improve bulk tanks and dispensing units.

It is another object of the present invention to make environmentally safe multi-storage bulk tanks and dispensing units.

It is still another object to have housed semi-mobile multi-storage bulk tanks and dispensing units.

A further object of the invention allows for recycling of used or spilled oil.

It is yet another object to safely port multi-bulk storage oil tanks collectively.

Accordingly, the present invention is directed to multi-storage tanks and dispensing units, comprising a securable housing having a top panel, a back panel, side panels, a front panel having a door securable connected to said front panel, and a deck panel having a spill well and a grate positioned thereover. A plurality of bulk oil storage tanks are operably disposed within the housing on the deck panel, wherein one of the tanks is further characterized to be a waste tank. A pump dispenser operably connects to the tanks via a tank pump conduit and is disposed within the housing on the deck panel. A valve in the tank pump conduit is provided for refilling the tank. Also, a recovery conduit operatively connects the spill well and the waste tank such that oil in the spill well flows into the waste tank.

The invention further includes a plurality of support beams longitudinally extending along and connected to the deck panel and disposed on a ground surface, a retaining panel interconnecting the support beams and the side panels to form a well area beneath the deck panel. The retaining panel is displaced above the ground surface.

There are provided a plurality of pump dispensers, wherein each pump dispenser is operably connected to one of the bulk oil tanks. Also, there are a plurality of spill wells with grates, wherein each spill well is located adjacent at least one pump dispenser. Also, each tank includes a vent and thermocouple to aid acclimation of said tanks to temperature changes.

DETAILED DESCRIPTION OF THE PREFERRED EMBODIMENT

Figure 1:
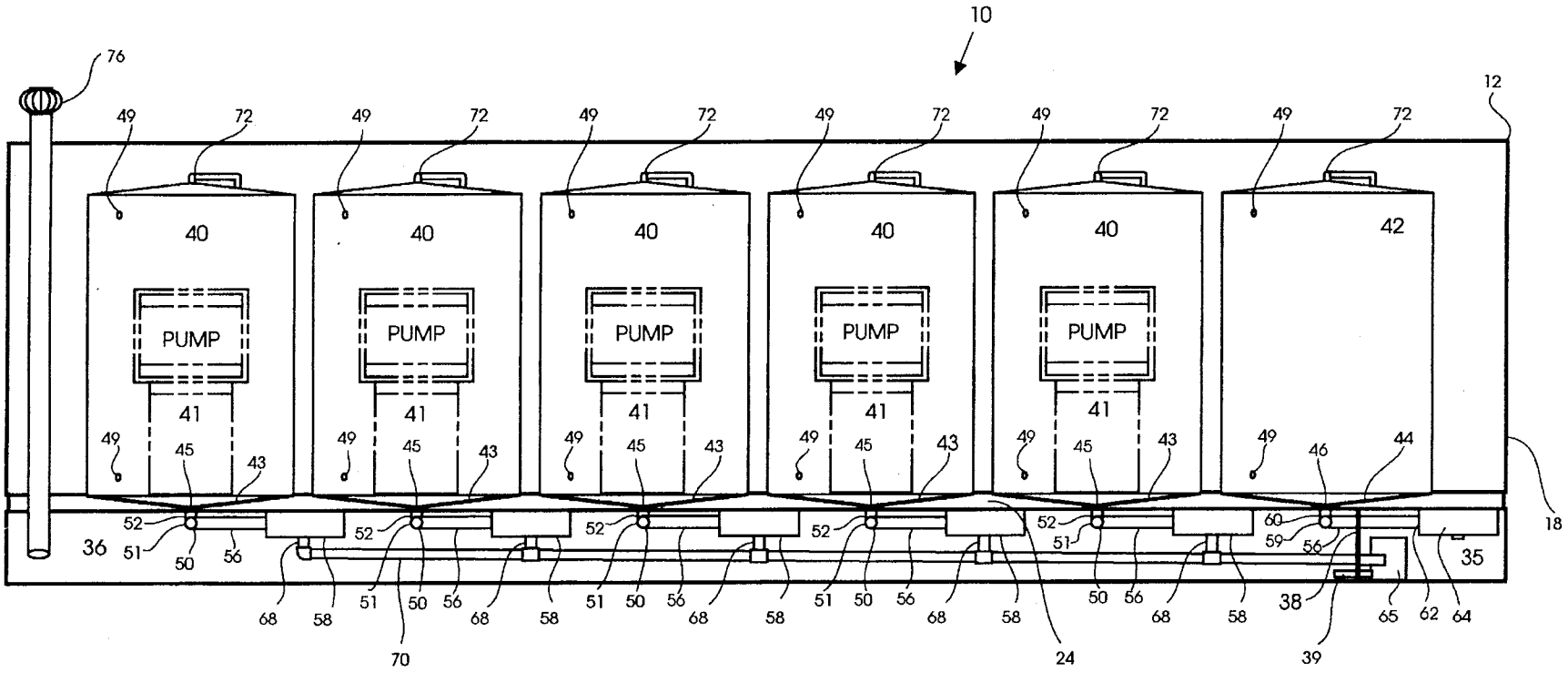
FIG. 1 is a front elevation view multi-storage bulk tanks and dispensing units.

Referring to the drawings, multi-storage bulk tanks and dispensing units of the present invention is generally denoted by the numeral 10. Included is a housing 12 which is made up of a top panel 14, a back panel 16, side panels 18, a front panel 20 and a door 22 and a deck panel 24. The housing is made of 0.25 inch gauge steel or comparable material to provide a protective barrier against the environment or vandalism.

The door 22 is hingedly connected to the front panel 20 and includes pneumatic opener 26 and locking mechanism 28 to secure the door 22 to the front panel 20 and deck panel 24. Alternatively, the door 22 could be slidably retractably mounted to the front panel 20. When secured to the housing 12, there is created a sealed environment to maintain contents therein and protect them from damage caused by the environment or vandalism.

The housing 12 is supported by a plurality of I-beams 30 which are situated below and connected to the deck panel 24 and connect to side panels 18. Retaining panels 32 interconnect upper lips 34 of I-beams 30. The retaining panels 32 are thus raised above the surface of the ground to prevent corrosion thereof. By so configuring the I-beams 30 and retaining panels 32, there is provided an ability to skid and or lift the housing 12 to another location.

Additionally, I-beams 30, side panels 18 and retaining panels 32 form safety well areas 35, 36 and 37, wherein well areas 35 and 36 are separated by a containment wall 38. One way check valves 39 are operably disposed into containment wall 38 and I-beam 30 adjacent the well area 35 in a manner to be slightly raised above the retaining panels 32 and permit flow only from well areas 36 and 37 into well area 35.

Disposed within the housing 12 are a plurality of bulk oil tanks 40 and pump dispensers 41. Pump dispensers 41 are of the type known in the art. A waste tank 42 is also provided within the housing 12. While there are shown a plurality of pump dispensers 41, it is contemplated that the tanks 40 could be operably connected to a multi-head dispenser thereby minimizing the number of such dispensers 41 required. The tanks 40 and 42 are positioned adjacent the back panel 16 and are spaced from one another there along. The tanks 40 and 42 are formed with a conical bottom 43 and 44, respectively, having an orifice 45 and 46, respectively, formed therein. The deck panel 24 is formed with a plurality of conical recess surface areas 47 having a centrally located opening 48 substantially the size of orifices 45 and 46. The surface areas 47 are of a configuration to receive bottom 43 and 44 of tanks 40 and 42, respectively, and aid in stabilization thereof.

The tanks 40 and 42 are equipped with thermocouples 49 for acclimation to particular environments. While two thermocouples 49 are shown, it is contemplated that more or less may be employed and may be of a type known to the art. Fluid sight glass pipe (not shown) as is known in the art is connected to each tank to enable determination of the amount of oil therein.

A conduit 50 has an end 52 which fits within the orifice 45 of tank 40 and extends below the deck panel 24 and through opening 51 in a central I-beam 30. Another end 54 connects to a base of the pump dispenser 41. A relief conduit 56 operably connects to the conduit 50 and extends into a spill well 58 formed in the deck panel 24.

For the waste tank 42, a conduit 59 has an end 60 which fits the orifice 46 of the tank 42. Another end 62 terminates into a spill well 64 formed in the deck panel 24. A sump pump 65 is disposed within waste well area 35 and is operably connected to conduit 59 to remove oil within the well area 35 and spill well 64 and pump it into the waste tank 42.

Figure 2:
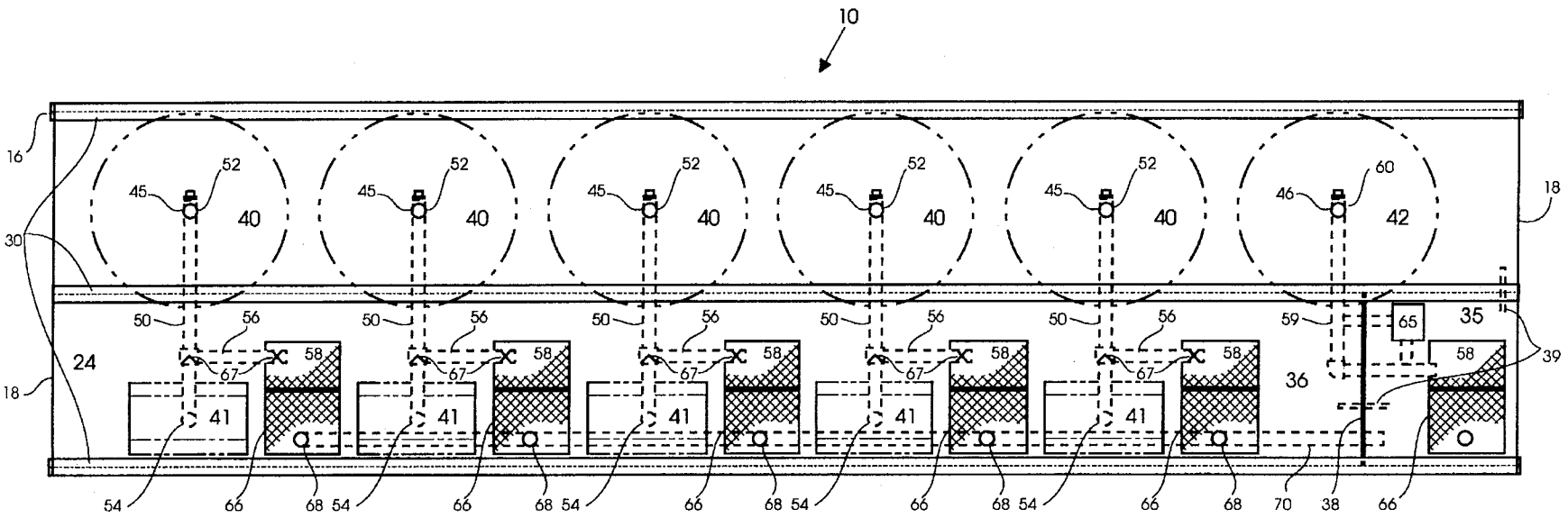
FIG. 2 is a top plan view of multi-storage bulk tanks and dispensing units of FIG. 1.
Figure 3:
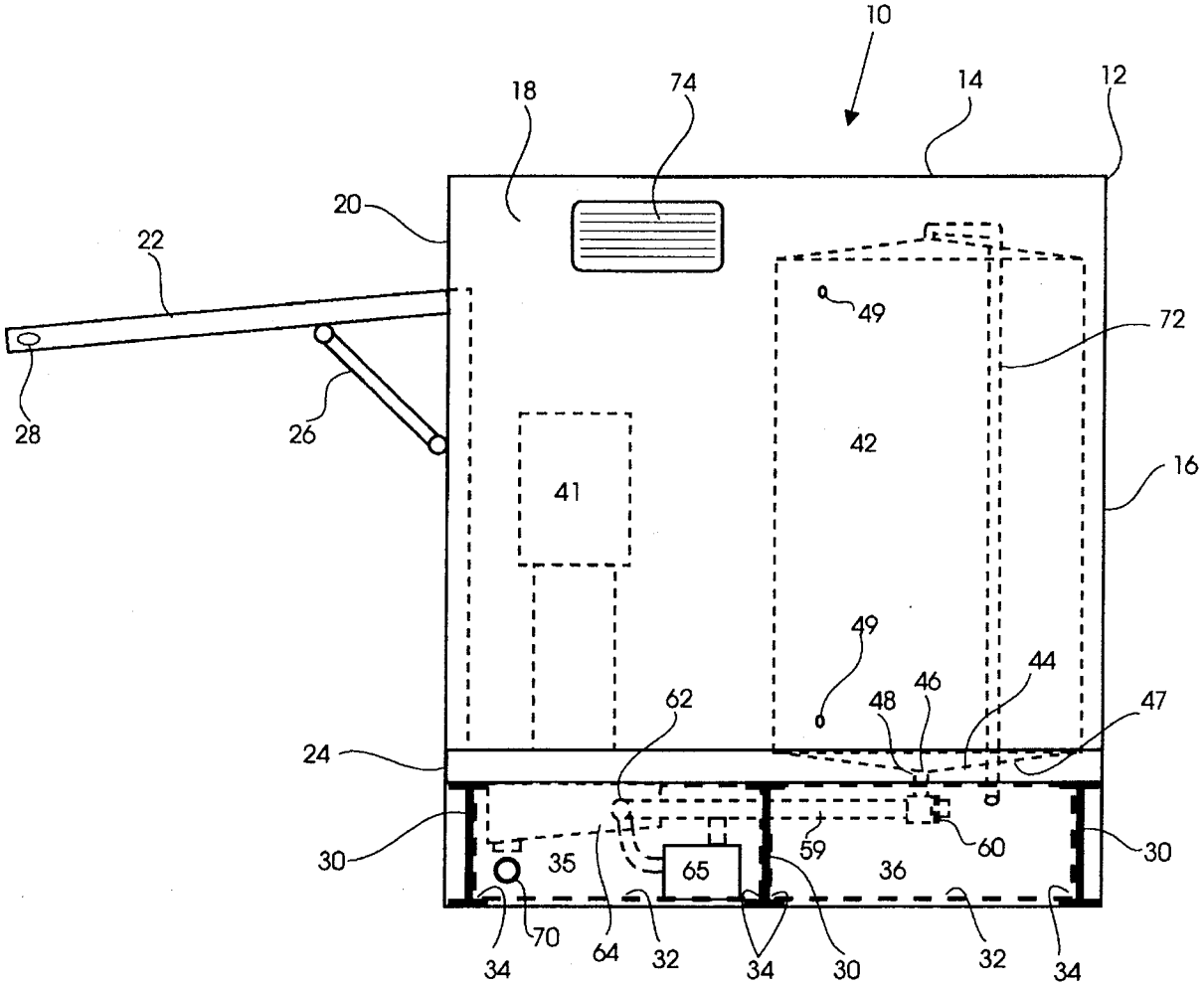
FIG. 3 is an end elevation view of multi-storage bulk tanks and dispensing units of FIG. 1.

Formed within the deck panel 24 are a plurality of removable grates 66 which are disposed adjacent the pump dispensers 41. The grates 66 are configured preferably of a size larger than a bulk bucket or refill container which a consumer will place thereon and are positioned over spill wells 58. The grates 66 can be of one piece construction but are preferably of two piece hingedly connected as shown in FIG. 2. In this regard, the portion of the grate 66 is disposed over the relief conduit 56 in a hinged fashion to permit opening and access to the conduit 56. Each relief conduit 56 is equipped with a valve mechanism 67 which can be actuated to create a conduit for refilling tanks 40. Although not shown, it is contemplated that the grates 66 are to be equipped with a locking mechanism, such as common rod extending through a welded loop to each grate 66 which is securable to the deck panel 24.

Spill wells 58 have a drain 68 downwardly extending therefrom which connect to a common drain pipe 70 terminating into the waste well area 35. The drain pipe 70 is slightly pitched to cause drainage into the waste well area 35. The spill well 64 adjacent the waste tank 42 is situated to specifically receive waste or used oil by a consumer and is operably connected to the pump 65 to remove the oil therefrom and place into the tank 42.

In operation, customers will place empty buckets to be filled on the grates 66. During the filling process, oil may overflow or spill in which case the oil will be safely contained and disposed into tank 42 for recycling. In the event there is a rupture in any of the tanks 40 or pump dispenser 41, the deck panel 24 is designed with a pitch for draining spills into spill wells 58 and 64. As another environmental safety feature, should a rupture occur causing spillage below the deck panel 24, as in the conduit 50, for example, the well areas 36 and 37 will capture the oil and, upon reaching height of valve 39, flow into well area 35 to be pumped into the tank 42.

The tanks 40 and 42 include a vent 72 to accommodate for environmental changes causing oil movement. The vent 72 can be a pipe or the like extending from an upper portion of the tanks 40 and 42 to the deck panel 24 to direct flow to the spill well 64.

A housing air vent 74 and turbine air vent 76 are provided to vent and remove volatile fumes which are created or collected within the housing and well areas 35, 36 and 37. In the case as is shown in FIG. 1 with only one vent 76 for areas 35, 36 and 37, there exist sufficient openings between the well areas 35, 36 and 37 for air communication. However, it is contemplated that each area may have its own vent.

It has therefore been shown in the above description and drawings that the above invention in the housed semi-mobile multi-storage tanks and dispensing units provides advantages and features over those known to the art. In particular, there is provided means for dispensing a plurality of types of bulk oils as well as collecting used or spilled oil in a particular location within environmentally safe housing. Also, the housing of the present invention provides a means of securing the tanks and pump dispensers against theft or vandalism.

The present invention has been set forth in the above drawings and description by way of example and is not intended to be limiting in the scope of protection which may be afforded to modifications, derivations and improvements readily apparent to those skilled in the art. Accordingly, the claims appended hereto should be accorded such scope of protection.

What is claimed is:

1. Multi-storage tanks and dispensing units, comprising:

a securable housing having a top panel, a back panel, side panels, a front panel having a door securably connectable thereto, and a deck panel having a spill well therein with a grate positioned thereover;

a plurality of bulk oil storage tanks operably disposed within said housing on said deck panel, wherein one of said tanks is further characterized to be a waste tank;

a pump dispenser disposed within said housing on said deck panel and is operably connectable to said tanks through a tank pump conduit; and a recovery conduit operatively connecting said spill well and said waste tank such that oil in said spill well is directed into said waste tank.

2. The multi-storage tanks and dispensing units of claim 1, further including a plurality of support beams longitudinally extending along beneath and connected to said deck panel and disposed on a ground surface, a retaining panel interconnecting said support beams and said side panels to form a well area beneath said deck panel, said retaining panel displaced above the ground surface.

3. The multi-storage tanks and dispensing units of claim 1, which is further characterized to include a plurality of pump dispensers wherein each said pump dispenser is operably connected to one of said bulk oil storage tanks through separate tank pump conduit.

4. The multi-storage tanks and dispensing units of claim 1, wherein said base deck panel further includes another spill well, and said recovery conduit interconnecting said spill wells and said waste well in a manner such that fluid flow is in the direction from said spill wells to said waste well.

5. The multi-storage tanks and dispensing units of claim 3, wherein said base deck panel is further characterized to include a plurality of spill wells therein, each said spill well having a grate thereover and wherein each said spill well is positioned adjacent one of said pump dispensers.

6. The multi-storage tanks and dispensing units of claim 1, wherein said grate is lockably securable to said deck panel.

7. The multi-storage tanks and dispensing units of claim 1, wherein said deck panel is characterized to include a pitch toward said spill well.

8. The multi-storage tanks and dispensing units of claim 1, wherein each said tank includes a venting conduit extending from said tank to said deck panel and to said spill well.

9. The multi-storage tanks and dispensing units of claim 2, which further includes a vent extending from outside said housing into said well area.

10. The multi-storage tanks and dispensing units of claim 2, which further includes means disposed in said well area and operatively connected to said spill well and said waste tank for pumping oil from said well area and spill well into said waste tank.

11. The multi-storage tanks and dispensing units of claim 1, wherein said housing includes a vent in a side panel thereof.

12. The multi-storage tanks and dispensing units of claim 1, wherein each said tank includes a thermocouple.

13. The multi-storage tanks and dispensing units of claim 1, wherein said tank pump conduit includes valve means for permitting filling of said tank with bulk oil.

14. Multi-storage tanks and dispensing units, comprising:

a securable housing having a top panel, a back panel, side panels, a front panel having a door securably connectable thereto, and a base deck panel having a plurality of spill wells, and each said spill well having a grate positioned thereover;

a plurality of bulk oil storage tanks operably disposed within said housing on said deck panel;

a waste tank operably disposed within said housing on said deck panel;

a plurality of pump dispensers disposed within said housing on said deck panel, each said pump dispenser operably connectable to one of said tanks through a tank pump conduit; and a recovery conduit operatively connecting said spill wells and said waste tank such that fluid flow in said spill well is directed into said waste tank.

15. The multi-storage tanks and dispensing units of claim 14, further including a plurality of support beams longitudinally extending along beneath and connected to said base deck panel and disposed on a ground surface, a retaining panel interconnecting said support beams and said side panels to form a well area beneath said deck panel, said retaining panel displaced above the ground surface.

16. The multi-storage tanks and dispensing units of claim 14, wherein said deck panel is pitched toward said spill wells and each said tank includes a venting conduit extending from said tank to said deck panel.

17. The multi-storage tanks and dispensing units of claim 14, wherein each said tank includes a thermocouple.

18. The multi-storage tanks and dispensing units of claim 14, which further includes a containment wall laterally disposed from said side walls and connecting said I-beams to sub-divide said well area into plural well areas, wherein a first of said well areas is positioned beneath said waste tank and a second of said well areas is positioned beneath said other bulk tank, and said containment wall includes a valve to permit flow from said second well area to said first well area.

19. The multi-storage tanks and dispensing units of claim 18, which further includes means disposed in said first well area and operatively connected to said spill well and said waste tank for pumping oil from said well area and spill well into said waste tank.

20. The multi-storage tanks and dispensing units of claim 15, which further includes a vent extending from outside said housing into said well area.

* * * * *